United States Patent [19]

Janssen et al.

[11] Patent Number: 4,599,068

[45] Date of Patent: Jul. 8, 1986

[54] APPARATUS FOR PREHEATING GRANULAR ORE

[75] Inventors: Wilhelm Janssen, Mülheim; Klaus Ulrich, Heiligenhaus, both of Fed. Rep. of Germany

[73] Assignee: Fried. Krupp Gesellschaft mit berschränkter Haftung, Essen, Fed. Rep. of Germany

[21] Appl. No.: 686,881

[22] Filed: Dec. 27, 1984

[30] Foreign Application Priority Data

Dec. 28, 1983 [DE] Fed. Rep. of Germany ..... 3347272

[51] Int. Cl.[4] ..... F27D 1/08; F26B 17/12; C21B 7/00; F27B 7/02

[52] U.S. Cl. ..... 432/97; 34/168; 266/175; 432/98; 432/106

[58] Field of Search ..... 266/175; 432/106, 95, 432/97, 98; 34/165, 168, 172

[56] References Cited

U.S. PATENT DOCUMENTS

| | | | |
|---|---|---|---|
| 2,148,946 | 2/1939 | Hubmann et al. | 34/168 |
| 3,832,128 | 8/1974 | Paul | 432/98 |
| 4,114,289 | 9/1978 | Boulet | 34/16 |

FOREIGN PATENT DOCUMENTS

| | | | |
|---|---|---|---|
| 954753 | 7/1978 | U.S.S.R. | 432/95 |

*Primary Examiner*—John J. Camby
*Attorney, Agent, or Firm*—Spencer & Frank

[57] ABSTRACT

An apparatus for preheating granular ore includes a shaft defined by vertical walls, an inlet chute disposed above the shaft for introducing the ore thereinto by gravity, an ore discharge collector situated underneath the shaft for receiving preheated ore therefrom, and an arrangement for passing heating gases upwardly in the shaft. The discharge collector has vertical side walls and further, there is provided an insert situated in the discharge collector and extending generally horizontally thereacross. The insert has a downwardly widening configuration. A discharge device is disposed at a lower end of the discharge collector.

11 Claims, 4 Drawing Figures

APPARATUS FOR PREHEATING GRANULAR ORE

BACKGROUND OF THE INVENTION

The invention relates to an apparatus for preheating granular ore or the like by means of hot gases, in particular flue gases obtained from a rotary tubular kiln. The apparatus has a shaft which is provided with vertical walls and through which hot gases flow from below in an upward direction, at least one inlet chute provided thereabove, a discharge collector provided underneath thereof and one or more passages which are provided between the shaft and the enlarged inlet cross section of the discharge collector and which serve as gas inlets.

Known apparatus for preheating the feed material such as granular ore or pellets (prior to its introduction into the tubular kiln) wherein the flue gases of the kiln are passed in cross flow through a mass of accumulated material by virtue of horizontal slots in the side walls of the shaft (so-called Venetian blind shaft preheaters), have the disadvantage that the feed material undergoes sintering along the surfaces facing the flow, whereby due to uneven flow through the material the heating is rendered inadequate and uneconomical.

A further known shaft preheater of the aforesaid type, in which gases pass through the shaft upwardly from below also fails to provide an adequate utilization of the heat of the flue gases of the kiln.

SUMMARY OF THE INVENTION

It is an object of the invention to provide an improved apparatus of the above-outlined type to ensure an amelioration of its heat output and to achieve a uniform heating of the ore or pellets to be treated.

This object and others to become apparent as the specification progresses, are accomplished by the invention, according to which, briefly stated, the discharge collector is provided with vertical side walls, a central, downwardly flaring insert and a discharge device at its lower end.

It is an advantage of the apparatus according to the invention that the gases flow substantially uniformly through the feed material and the mass flow of the granular ore or pellets over the entire cross section of the shaft as well as the discharge collector proceeds uniformly. On the outer surfaces of the material pile exposed to the gas, a continuous exchange of the material takes place so that a sintering of the ore due to the coal dust particles contained in the flue gas is avoided. Due to the thorough and uniform flow through the material, the output of the after-connected fan may be designed to be small.

The upper end of the downwardly flaring insert extends approximately to the level of the largest horizontal cross section of the conical material pile emerging from the shaft and the area of such cross section (determined by the vertical walls of the discharge collector) is 1.5 to 1.6 times greater than that of the cross-sectional area of the shaft. This, as demonstrated by experiments, permits the attainment of the particularly favorable results. Preferably, the width of the shaft extending parallel to the end walls amounts to 1.1 to 1.3 times the height of the piled-up material along the side walls interconnecting the end walls. Also, the height of the piled-up material along the side walls of the discharge collector amounts preferably to 0.6 to 0.8 times the height of the pile in the shaft.

Advantageously, the shaft and the discharge collector each are essentially rectangular in a horizontal cross section and also, in the shaft and the discharge collector two mutually opposing side walls each form end walls, which in associated pairs are in alignment one above the other. Such embodiments provide for a particularly simple construction of the apparatus.

DESCRIPTION OF THE PREFERRED EMBODIMENT

Figure 1:
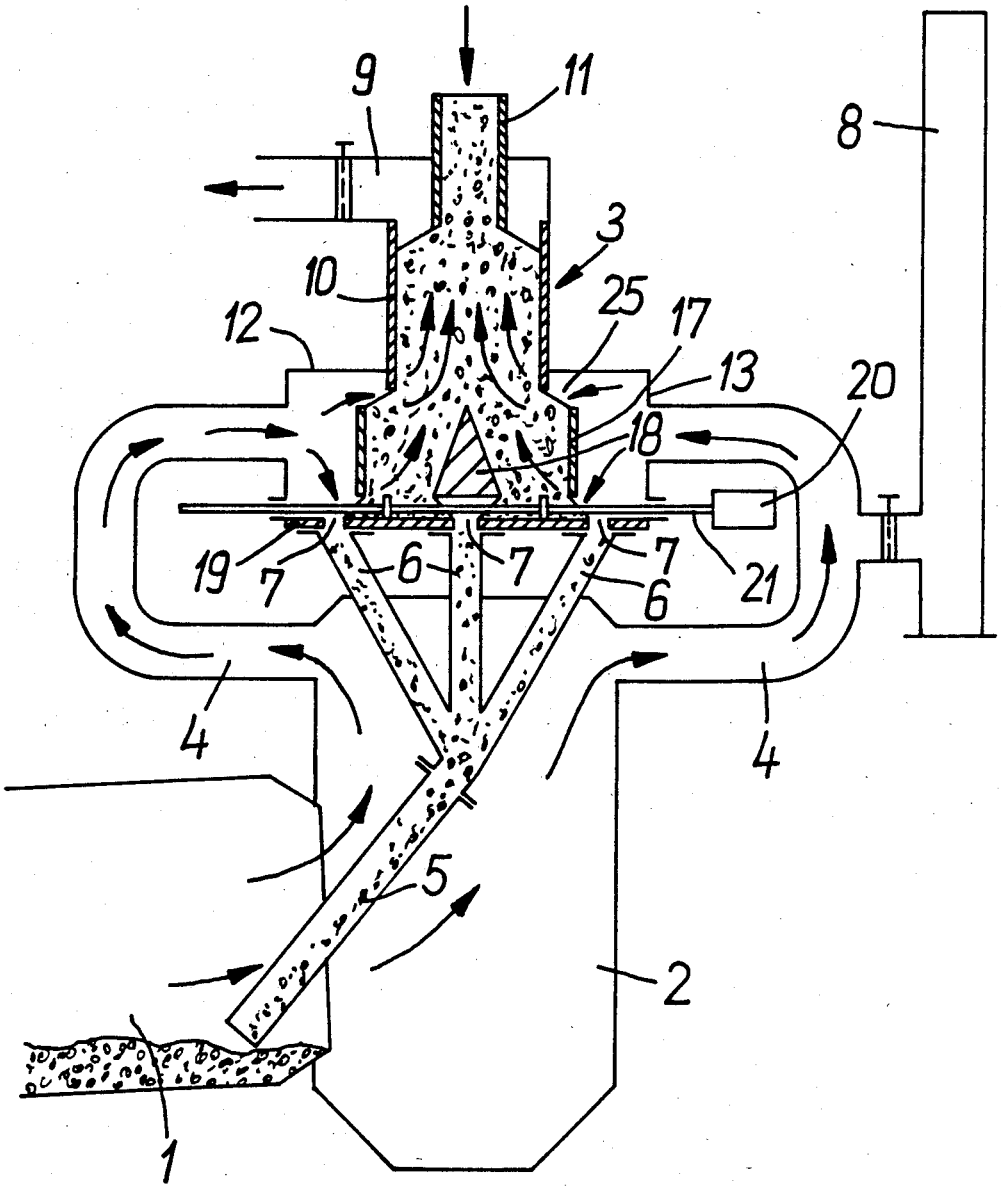
FIG. 1 is a schematic sectional elevational view of a preferred embodiment of the invention.

Turning now to FIG. 1, a dust chamber 2 is in sealing relationship with the upper discharge end of a rotary tube kiln 1 operated in countercurrent. Gas pipes 4 lead from the upper region of the dust chamber 2 to a preheating apparatus 3. A material inlet pipe 5 has a lower end opening into the kiln 1 and is subdivided into three upwardly extending branches 6 which are connected to discharge apertures 7 of the preheating apparatus 3 at its underside. A closable emergency chimney 8 is connected to the gas pipes 4. As indicated by arrows, the flue gases leaving the rotary tube kiln 1 first flow into the dust chamber 2 and then proceed, by way of the gas pipes 4, into the preheating apparatus 3, leaving the latter by way of a gas outlet pipe 9 connected to the preheating apparatus 3 in an upper zone thereof.

Figure 2:
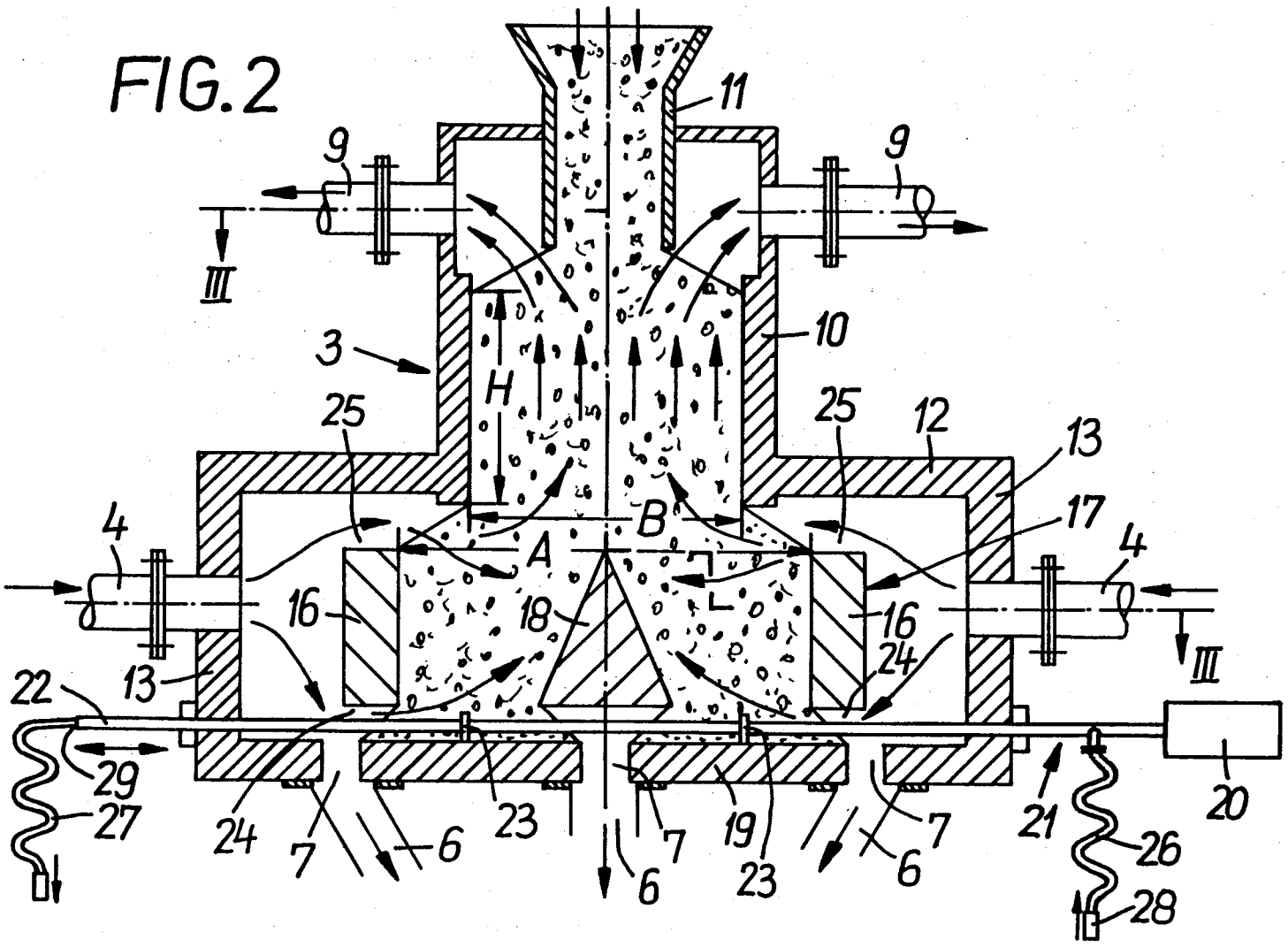
FIG. 2 is an enlarged detail of FIG. 1.
Figure 3:
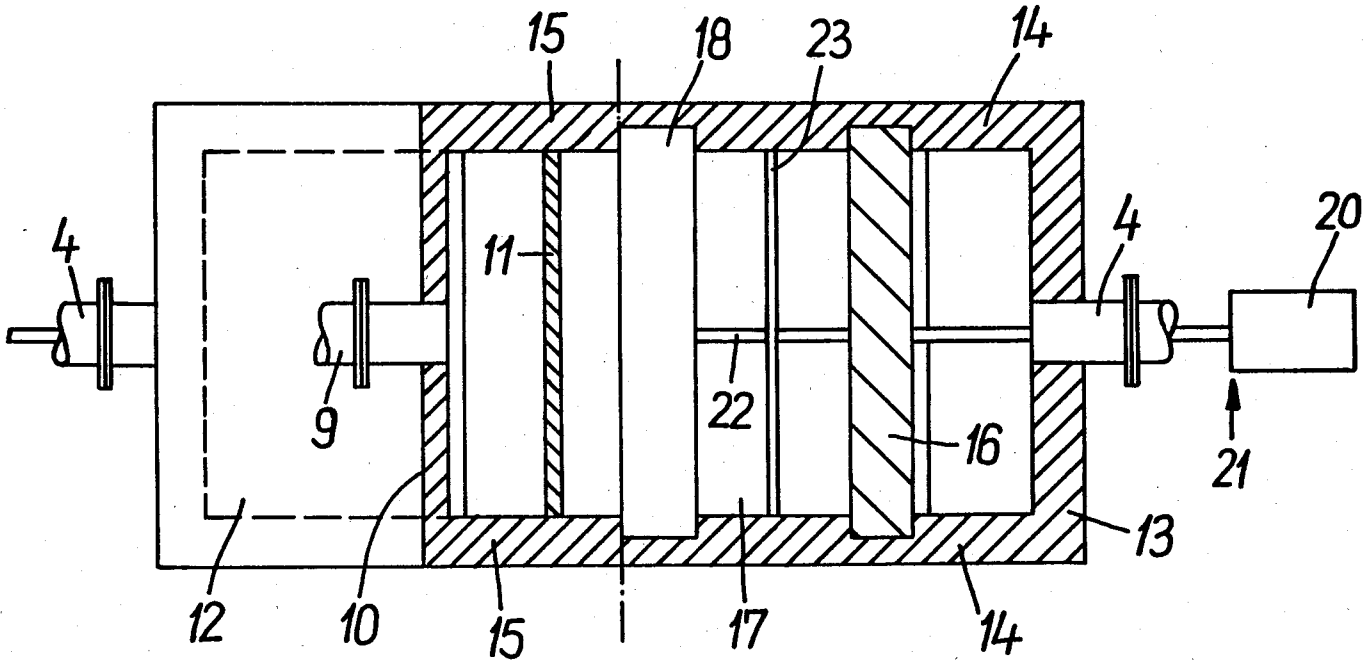
FIG. 3 is a sectional view taken along the line III—III of FIG. 2.

The preheating apparatus 3 in its upper region comprises an upwardly closed and downwardly open shaft 10 which has a rectangular horizontal cross-sectional outline. The preheating apparatus has, in its upper region above the piled-up material, lateral connections for the gas discharge pipe 9. A charging chute 11 passes from above downwardly into the shaft 10 for introducing the material to be heated, primarily small-size granular ore having a grain size of 5 to 25 mm or pellets having a grain size of 6 to 20 mm. Below the shaft 10, in symmetry therewith, a chamber 12 is provided which too, has a horizontally rectangular cross-sectional outline and which, as also seen in FIGS. 2 and 3, projects laterally in relation to the shaft 10 on two opposite sides 13. The other side walls of the chamber 12 form end walls 14 and lie with the corresponding end walls 15 of the shaft 10 in a common vertical plane. Two vertical walls 16 are provided symmetrically in the chamber 12 which form a discharge collector 17 jointly with a portion of the end walls 14. In the center of the discharge collector 17 or the chamber 12 there is arranged a prismatic insert 18, which flares downwardly from a pointed top and which extends transversely to the longitudinal dimension of the chamber 12, symmetrically thereto, from one end wall 14 to the opposite end wall 14. The chamber 12 moreover comprises a flat bottom 19 which, if required, may be provided with cooling devices. The bottom 19 at the same time constitutes the lower confines of the discharge collector 17 and comprises the discharge apertures 7.

A slider device 21 driven by a motor 20, generating back and forth movements, comprises a slider rod 22 connected to the motor 20 and extending above the bottom 19 parallel thereto. To the rod 22 there are attached two sliders 23 extending between the end walls 14 and lying on the bottom 19 at a distance to one another corresponding approximately to half the distance of the two walls 16 from one another. The discharge apertures 7 have a slot-shaped configuration and extend parallel to the walls 16. One of the discharge apertures 7 is centrally arranged below the insert 18 and two other discharge openings 7 are each situated slightly laterally externally of the walls 16. The stroke of the slider device 21 is so set that each of the sliders 23 is moved back and forth between two adjoining discharge apertures 7. The slider device, if necessary, is water-cooled in the same manner as the bottom 19. The walls 16 are spaced from the bottom 19 by a distance corresponding approximately to the width of the discharge apertures 7. This results in the formation of gas inlet apertures 24 which at the same time also serve as the outlet for the heated material to be discharged by the sliders 23. The lower end of the prismatic insert 18 is also at a distance from the bottom 19, resulting similarly in the formation of two connecting apertures to the central discharge aperture 7 which thus can similarly be fed with material by the two sliders 23.

The walls 16 are each at a distance from the upper sides of the chamber 12, whereby passages 25 are formed for an adequately large gas feed into the material undergoing treatment. The base of the material cone emerging from the shaft 10 extends close to the upper edge of the walls 16. The distance A between the two walls 16 amounts to 1.55 times the distance B between the two opposite side walls of the shaft 10 by which the end walls 15 of the shaft 10 are interconnected. Because the end walls 15 and 14 are superposed and the top edge of the prismatic insert 18 is at the same level as the upper edges of the walls 16, the cross-sectional area in that region also amounts to 1.55 times the open cross-sectional area of the shaft 10. The height H of the shaft 10 which extends from its lower end to the level up to the highest location where the material is piled up along the side walls, is so set by the level adjustment of the rectangular feed chute 11 extending between the end walls 15 that $B=1.2$ H. The height of the material pile along the walls 16 of the discharge collector (measured from the bottom 19) amounts to 0.7 H.

The flue gas of the rotary tube kiln which has a temperature of 800° to 1000° C. is fed into the preheating apparatus 3 by way of gas pipes 4 connected by appropriate inlet nipples to the outer side walls of the chamber 12. Approximately nine-tenths of the flue gas enters the material pile by way of the apertures 25 and from there the gas flows into the shaft 10. The remaining one tenth passes through the lower gas feed apertures 24 into the discharge collector 17 and also flows through the material from below in an upward direction. From the shaft 10 the gas emerges at a temperature of 150° to 300° C. and by way of the gas discharge pipes 9 enters into an after-connected dust filter. The withdrawal of the gas is effected by way of a suction fan. The gas velocity can be so adjusted by the advantageous configuration of the preheating apparatus 3 that it is kept far below the so-called fluidization point at which the solid particles become entrained. An amount of 1 $Nm^3$ per kg of ore or pellets was found to be an adequate gas volume to be employed for the preheating procedure. That portion of the rotary kiln flue gases, usually the major portion, which is not required for preheating the material, can be utilized for other purposes.

At least those walls of the preheating apparatus which are contacted by hot material are lined with a suitable ceramic material. An embodiment of a water-cooling arrangement for the slider device 21 is shown in FIG. 2. For this purpose a flexible hose 26 of a feeder pipe 28 which is connected to a supply of cooling water is joins to the hollow slider rod 22 near its end adjacent to the motor 20. A similar flexible hose 27 connected to the collecting tank of the water supply is attached to the other end 29 of the rod 22.

Figure 4:
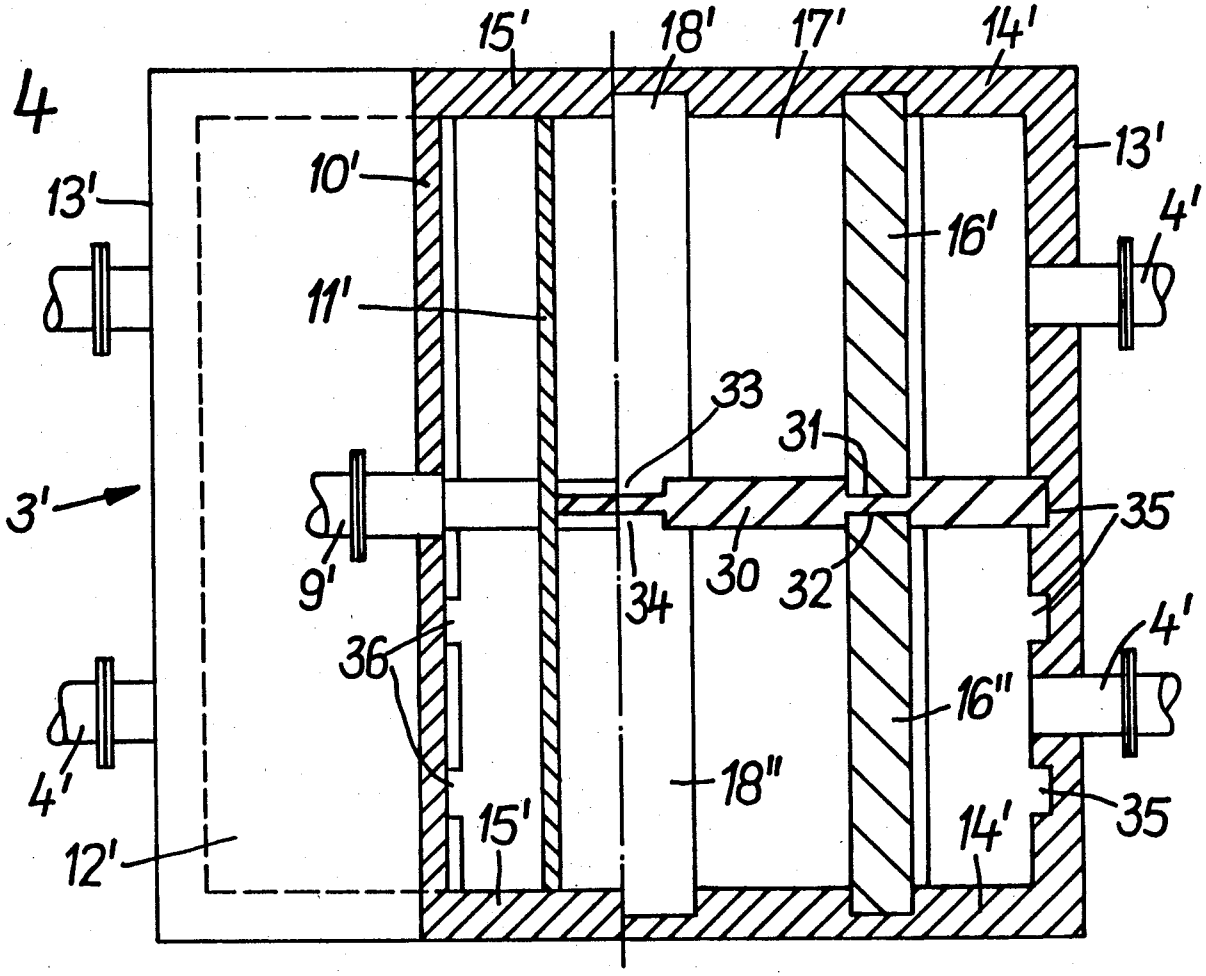
FIG. 4 is a sectional view like FIG. 3 showing another embodiment of the invention.

Turning now to FIG. 4, there is illustrated a preheating apparatus 3' having the same dimensions as the apparatus 3 excepting the distance between its end walls 14 and 15 which correspond to respective walls 14' and 15' of apparatus 3'. The other parts of the apparatus 3' which are also similar to those of apparatus 3 are provided with the same numerals but marked with a prime sign. Thus, the apparatus 3' also comprises side walls 13' and vertical walls 16', and in its upper region a shaft 10' and a charging chute 11'. Between the side walls 13' and the side walls of the shaft 10' is positioned a partition 30 extending over the entire vertical cross section of the apparatus until the top region of shaft 10'. The partition 30 has at opposite sides vertically extending recesses 31 and 32 in which the ends of respective wall portions 16' and 16'' are inserted. The other ends of the wall portions 16' and 16'' are inserted in similar recesses in each of the end walls 14'. Two opposite triangular recesses 33 and 34 are arranged at the partition 30 in its central region which adapt the ends of the prismatic respective inserts 18' and 18. Each of the side walls 13' as well as each of the walls of the shaft 10' have three vertically extending recesses 35 and 36, paired off for adaption of the partition 30 in three different positions. To place the partition 30 in another position, the detachable upper part of apparatus 3' comprising the shaft 10' and the upper walls of the chamber 12' is removed and simultaneously the wall portions 16' and 16'' and the prismatic inserts 18' and 18'' are replaced by other such parts having the respective fitting length. Thus the throughput of the apparatus can be easily adapted to different demands in practice. The number of gas inlet pipes 4' in the walls 13' depends on the gas volume required. As discharge apertures serve several flaps (not shown) arranged at the underside of apparatus 3' from which only the needed number is operated.

It will be understood that the above description of the present invention is susceptible to various modifications, changes and adaptations, and the same are intended to be comprehended within the meaning and range of equivalents of the appended claims.

What is claimed is:

1. In an apparatus for preheating granular ore, including means defining a shaft, means defining an inlet chute disposed above the shaft for introducing the ore thereinto by gravity, means defining an ore discharge collector situated underneath the shaft for receiving ore therefrom, the improvement wherein said means defining said shaft includes parallel, vertical first and second end walls adjoined by parallel, vertical first and second side walls; said shaft having essentially a rectangular horizontal cross-sectional shape; further wherein said means defining said discharge collector includes parallel, vertical third and fourth end walls adjoined by parallel, vertical third and fourth side walls; said discharge collector having essentially a rectangular horizontal cross-sectional shape; said first and second end walls of said shaft being situated above and in a coplanar relationship with said third and fourth end walls, respectively, of said discharge collector; the improvement further comprising an insert body situated in said discharge collector and extending generally horizontally thereacross, said insert body having a downwardly widening configuration; discharge means disposed at a lower end of said discharge collector for removing the preheated ore therefrom; and gas guiding means for introducing a first part of heating gases into said discharge collector in an upwardly-directed flow therethrough and for introducing a second part of heating gases directly into said shaft in an upwardly-directed flow therethrough; said gas guiding means for introducing said second part including gas passages defined between said shaft and said discharge collector; said gas guiding means being arranged such that said second part of said heating gases is substantially greater than said first part of said heating gases.

2. An apparatus as defined in claim 1, wherein said insert body has a highest portion situted at a height level of a highest part of said discharge collector further wherein said shaft and said highest part of said discharge collector have respective cross-sectional areas; the cross-sectional area of said highest part of said discharge collector being 1.5–1.6 times larger than the cross-sectional area of said shaft.

3. An apparatus as defined in claim 1, wherein said shaft has a width measured parallel to said first and second end walls thereof; said shaft having a height determining the height of an ore column accumulated therein; said width being 1.1–1.3 times greater than said height of said shaft.

4. An apparatus as defined in claim 3, wherein said discharge collector has a height determining the height of an ore column accumulated therein; the height of said discharge collector being 0.6–0.8 times less than the height of said shaft.

5. An apparatus as defined in claim 1, wherein said insert body is prismatic and has a triangular vertical cross section extending parallel to said third and fourth end walls of said discharge collector.

6. An apparatus as defined in claim 1, wherein said shaft and said discharge collector each is present in a plurality in a side-by-side arrangement; said first, second, third and fourth end walls constitute partitions between adjoining shafts and adjoining discharge collectors.

7. An apparatus as defined in claim 6, wherein said partitions are displaceable.

8. An apparatus as defined in claim 1, further comprising gas inlet openings provided in a lower zone of said third and fourth side walls of said discharge collector.

9. An apparatus as defined in claim 8, further comprising means defining a lateral chamber surrounding said discharge collector and gas inlet nipples supported in said chamber.

10. An apparatus as defined in claim 1, wherein said discharge collector has a planar bottom; said discharge means comprising ore discharge openings provided in said third and fourth side walls and adjacent said bottom and a slide means supported in said discharge collector parallel to said bottom for moving ore from said discharge collector through said ore discharge openings.

11. An apparatus as defined in claim 10, further comprising means for cooling said slide means.

* * * * *